US008494420B2

(12) United States Patent
Taguchi et al.

(10) Patent No.: US 8,494,420 B2
(45) Date of Patent: Jul. 23, 2013

(54) DEVELOPMENT AGENT SUPPLY DEVICE AND IMAGE FORMING APPARATUS HAVING THE SAME

(75) Inventors: Kazuna Taguchi, Aichi (JP); Keisuke Takahashi, Aichi (JP); Kenjiro Nishiwaki, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 322 days.

(21) Appl. No.: 12/893,487

(22) Filed: Sep. 29, 2010

(65) Prior Publication Data

US 2011/0103848 A1 May 5, 2011

(30) Foreign Application Priority Data

Oct. 30, 2009 (JP) ..... 2009-250262
May 31, 2010 (JP) ..... 2010-124014

(51) Int. Cl.
*G03G 15/08* (2006.01)

(52) U.S. Cl.
USPC ..... 399/281; 399/266; 399/291

(58) Field of Classification Search
USPC ..... 399/266, 290, 291, 281, 283
See application file for complete search history.

(56) References Cited

U.S. PATENT DOCUMENTS 4,624,559 A 11/1986 Haneda et al. ..... 399/236
5,142,336 A 8/1992 Hotomi et al. ..... 399/281
5,701,553 A * 12/1997 Endo et al. ..... 399/266 X
6,208,825 B1 * 3/2001 Hays ..... 399/266
6,314,257 B1 11/2001 Ishii et al. ..... 399/281
8,275,298 B2 * 9/2012 Maeda et al. ..... 399/281
2009/0175662 A1 7/2009 Nishiwaki ..... 399/281
2009/0214270 A1 * 8/2009 Kataoka et al. ..... 399/266

FOREIGN PATENT DOCUMENTS

CN 1267004 A 9/2000
EP 1 033 630 A2 9/2000

(Continued)

OTHER PUBLICATIONS

Extended European Search Report and Search Opinion dated Aug. 30, 2011 from related European Patent Application No. 10012405.6.

(Continued)

*Primary Examiner* — Sophia S Chen
(74) *Attorney, Agent, or Firm* — Scully, Scott, Murphy & Presser PC

(57) ABSTRACT

A development agent supply device is provided, which includes a development agent holding member configured to rotate around an axis parallel to a first direction such that a development agent holding surface, which faces an intended device to be supplied with development agent in a first position, moves in a second direction perpendicular to the first direction, a transfer board configured to charge and transfer development agent thereon to a second position to face the development agent holding surface, and a facing member disposed to face the development agent holding surface in a position between the first position and the second position in the second direction, the facing member being configured to charge development agent held on the development agent holding surface under an alternating electric field generated between the facing member and the development agent holding member.

18 Claims, 8 Drawing Sheets

FOREIGN PATENT DOCUMENTS

| | | | | |
|---|---|---|---|---|
| EP | 1 033 630 | A3 | | 3/2004 |
| EP | 2 199 872 | A2 | | 6/2010 |
| EP | 2 199 872 | A3 | | 12/2010 |
| JP | HEI 3-12678 | | | 1/1991 |
| JP | 8-146732 | | | 6/1996 |
| JP | 9-34249 | | | 2/1997 |
| JP | 2001-75357 | | | 3/2001 |
| JP | 2002-287495 | | | 10/2002 |
| JP | 2004-279880 | | | 10/2004 |
| JP | 2007-171589 | A | * | 7/2007 |
| JP | 2008-70803 | | | 3/2008 |

OTHER PUBLICATIONS

Partial European Search Report dated May 4, 2011 from EP 10012405.6.

Office Action dated Jun. 6, 2012 received from the Chinese Patent Office from related Chinese Application No. 201010538366.6, together with an English-language translation.

* cited by examiner

DEVELOPMENT AGENT SUPPLY DEVICE AND IMAGE FORMING APPARATUS HAVING THE SAME

CROSS-REFERENCE TO RELATED APPLICATION

This application claims priority under 35 U.S.C. §119 from Japanese Patent Applications No. 2009-250262 filed on Oct. 30, 2009 and No. 2010-124014 filed on May 31, 2010. The entire subject matters of the applications are incorporated herein by reference.

BACKGROUND

1. Technical Field

The following description relates to one or more development agent supply devices configured to supply charged powdered development agent to an intended device.

2. Related Art

A development agent supply device has been known that includes a development agent holding member (a development roller), an upstream development agent transfer unit, and a downstream development agent transfer unit.

The development agent holding member is disposed to face an electrostatic latent image holding body (a photoconductive drum) in a predetermined development area. The development agent holding member has a development agent holding surface on which charged development agent is held and carried.

The upstream development agent transfer unit has an upstream transfer surface, which is disposed upstream relative to the development area in a moving direction of the development agent holding surface (i.e., in a rotational direction of the development roller) so as to face the development agent holding surface across a predetermined distance. The upstream development agent transfer unit is configured to generate an upstream transfer electric field (i.e., an electric field for transferring the development agent held on the upstream transfer surface from an upstream side to a downstream side in the moving direction of the development agent holding member).

The downstream development agent transfer unit has a downstream transfer surface, which is disposed downstream relative to the development area in the moving direction of the development agent holding surface so as to face the development agent holding surface across a predetermined distance. The upstream development agent transfer unit is configured to generate a downstream transfer electric field (i.e., an electric field for transferring the development agent held on the downstream transfer surface from an upstream side to a downstream side in the moving direction of the development agent holding member).

In the above configuration, the electric fields, for transferring the charged development agent from an upstream side to a downstream side in the moving direction of the development agent holding member, are generated in spaces on the upstream transfer surface and the downstream transfer surface. Thereby, the development agent is transferred, on each of the upstream transfer surface and the downstream transfer surface, from the upstream side to the downstream side in the moving direction of the development agent holding member.

The development agent, carried by the upstream development agent transfer unit, is transferred onto the development agent holding surface in a position where the upstream transfer surface faces the development agent holding surface. Thereby, the development agent adheres to the development agent holding surface. Namely, the development agent is held and carried on the development agent holding surface.

A part of the development agent held on the development agent holding surface is supplied and consumed in the development area to develop an electrostatic latent image. In other words, when reaching the development area, the development agent held on the development agent holding surface partially adheres to positions, corresponding to the electrostatic latent image, on an electrostatic latent image holding surface that is a circumferential surface of the electrostatic latent image holding body.

The remaining part, of the development agent held on the development agent holding surface, which has not adhered to the electrostatic latent image holding surface (i.e., which has not been consumed in the development area), is retrieved by the downstream development agent transfer unit, and then transferred, on the downstream transfer surface, from the upstream side to the downstream side in the moving direction of the development agent holding surface.

SUMMARY

However, the known development agent supply device has a problem of a low efficiency in transferring (supplying) the development agent from the development agent holding surface of the development agent holding member to the electrostatic latent image holding surface of the electrostatic latent image holding body.

Aspects of the present invention are advantageous to provide one or more improved configurations for a development agent supply device that make it possible to enhance efficiency in supplying development agent on a development agent holding surface to an electrostatic latent image holding surface.

According to aspects of the present invention, a development agent supply device is provided that is configured to supply charged development agent to an intended device. The development agent supply device includes a development agent holding member that has a development agent holding surface that is formed to be a cylindrical circumferential surface parallel to a first direction and disposed to face the intended device in a first position, the development agent holding member being configured to rotate around an axis parallel to the first direction such that the development agent holding surface moves in a second direction perpendicular to the first direction, a transfer board provided along a development agent transfer path perpendicular to the first direction, the transfer board being configured to charge development agent on the development agent transfer path and transfer the charged development agent along the development agent transfer path to a second position where the transfer board faces the development agent holding surface in closest proximity to the development agent holding surface, such that the charged development agent is transferred to and held on the development agent holding surface in the second position, and a facing member disposed to face the development agent holding surface in a position between the first position and the second position in the second direction, the facing member being configured to charge the development agent held on the development agent holding surface under an alternating electric field generated between the facing member and the development agent holding member.

According to aspects of the present invention, further provided is an image forming apparatus that includes a photoconductive body configured such that a development agent image is formed thereon, and a development agent supply device configured to supply charged development agent to the photoconductive body. The development agent supply device includes a development agent holding member that has a development agent holding surface that is formed to be a cylindrical circumferential surface parallel to a first direction and disposed to face the photoconductive body in a first position, the development agent holding member being configured to rotate around an axis parallel to the first direction such that the development agent holding surface moves in a second direction perpendicular to the first direction, a transfer board provided along a development agent transfer path perpendicular to the first direction, the transfer board being configured to charge development agent on the development agent transfer path and transfer the charged development agent along the development agent transfer path to a second position where the transfer board faces the development agent holding surface in closest proximity to the development agent holding surface, such that the charged development agent is transferred to and held on the development agent holding surface in the second position, and a facing member disposed to face the development agent holding surface in a position between the first position and the second position in the second direction, the facing member being configured to charge the development agent held on the development agent holding surface under an alternating electric field generated between the facing member and the development agent holding member.

BRIEF DESCRIPTION OF THE ACCOMPANYING DRAWINGS

Figure 5:
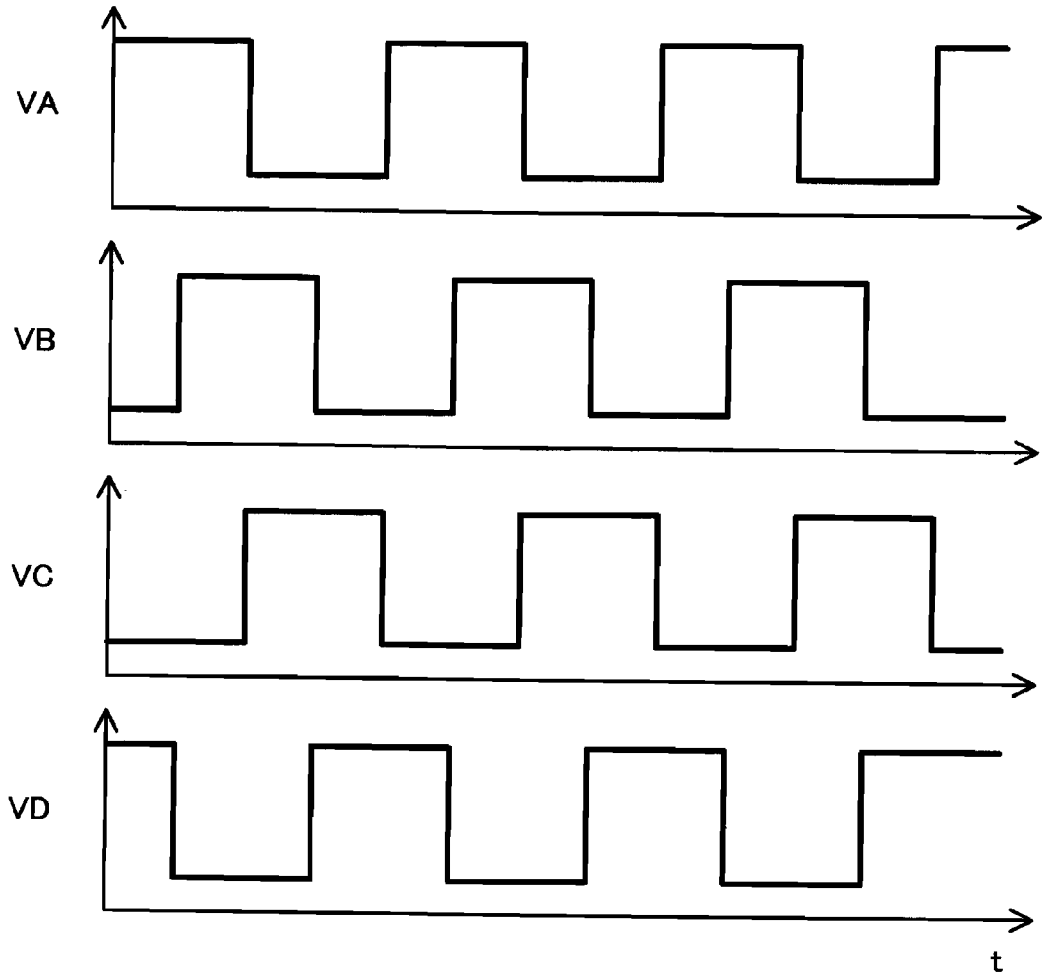

FIG. 5 exemplifies waveforms of voltages generated by power supply circuits for the transfer board in the embodiment according to one or more aspects of the present invention.

FIGS. 6A to 6D schematically show behaviors of particle(s) of powdered toner in the embodiment according to one or more aspects of the present invention.

Figure 7:
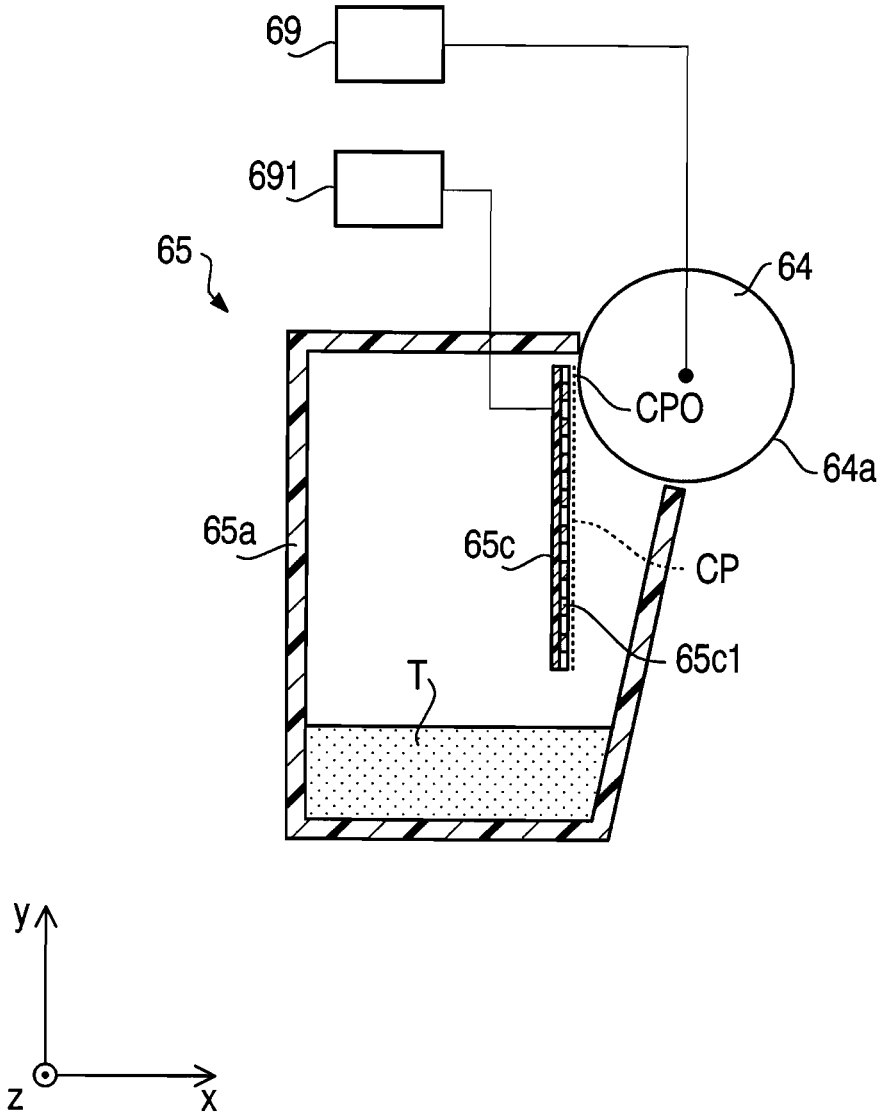

FIG. 7 is an enlarged cross-sectional side view of a cleaner for a toner supply device in a modification according to one or more aspects of the present invention.

Figure 8:
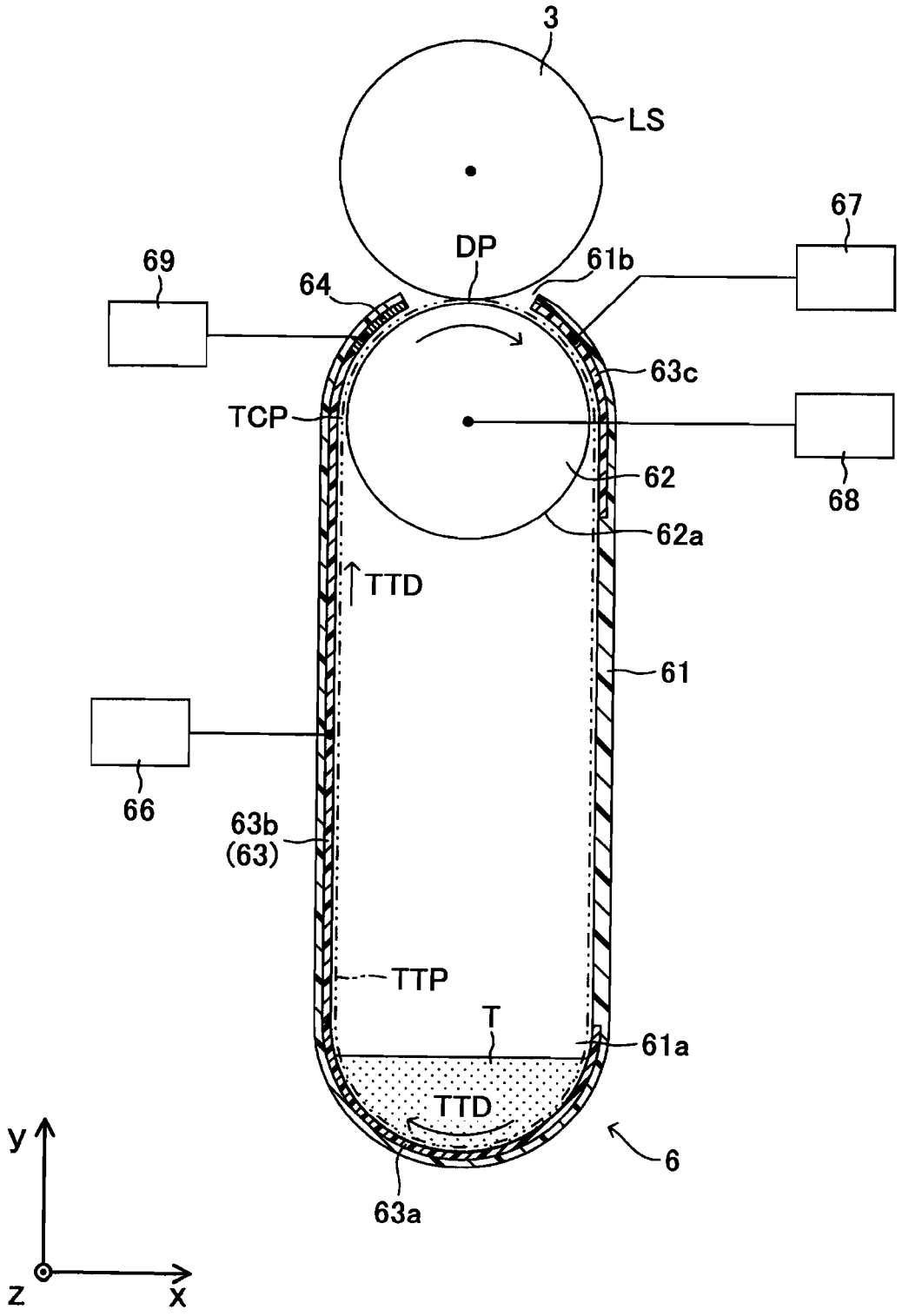

FIG. 8 is an enlarged cross-sectional side view of a toner supply device in a modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings.

<Configuration of Laser Printer>

Figure 1:
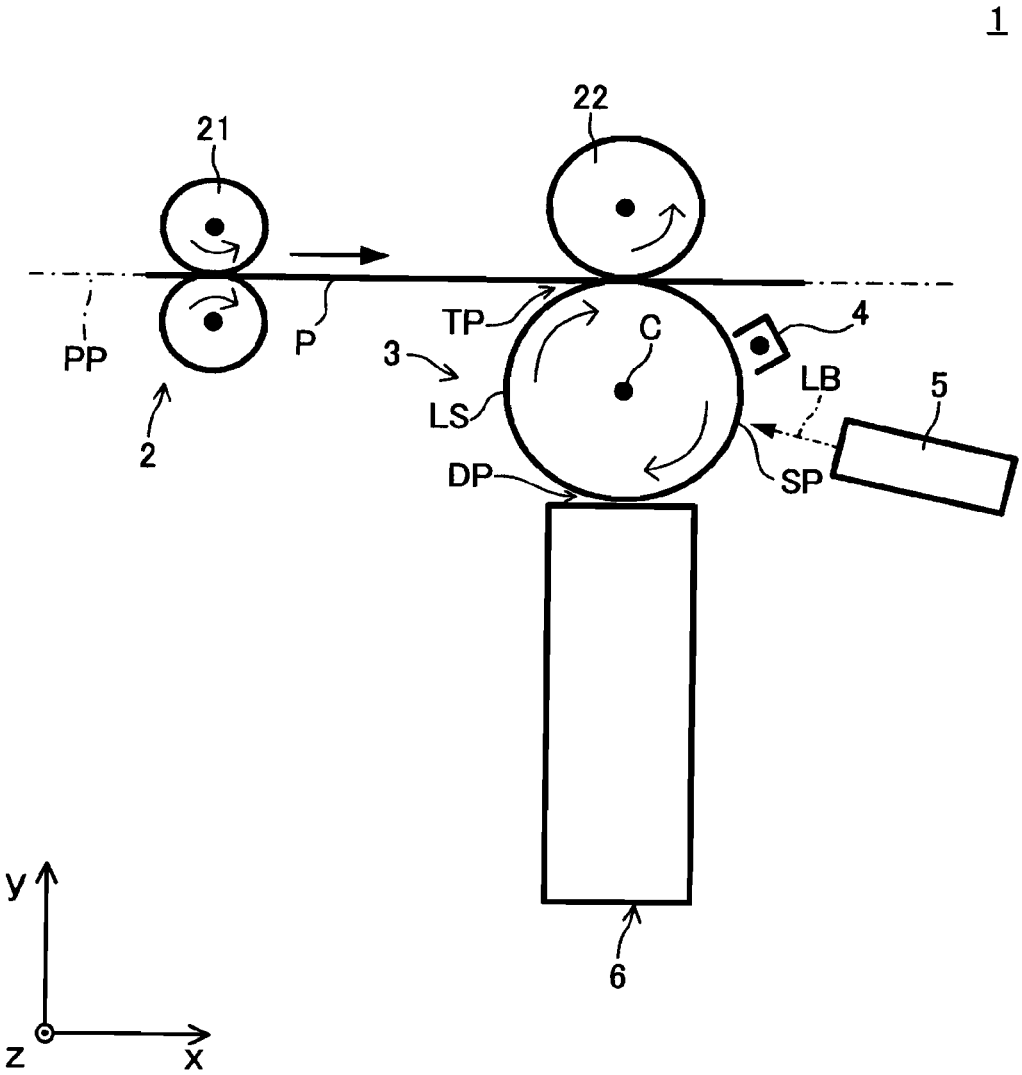
FIG. 1 is a side view schematically showing a configuration of a laser printer in an embodiment according to one or more aspects of the present invention.

As illustrated in FIG. 1, a laser printer 1 includes a sheet feeding mechanism 2, a photoconductive drum 3, an electrification device 4, a scanning unit 5, and a toner supply device 6.

A feed tray (not shown), provided in the laser printer 1, is configured such that a stack of sheets P is placed thereon. The sheet feeding mechanism 2 is configured to feed a sheet P along a predetermined sheet feeding path PP.

On a circumferential surface of the photoconductive drum 3, an electrostatic latent image holding surface LS is formed as a cylindrical surface parallel to a main scanning direction (i.e., a z-axis direction in FIG. 1). The electrostatic latent image holding surface LS is configured such that an electrostatic latent image is formed thereon in accordance with an electric potential distribution. Further, the electrostatic latent image holding surface LS is configured to hold toner T (see FIG. 2) in positions corresponding to the electrostatic latent image.

The photoconductive drum 3 is driven to rotate in the direction indicated by arrows (clockwise) in FIG. 1 around a central axis C that is parallel to the main scanning direction. Thus, the photoconductive drum 3 is configured to move the electrostatic latent image holding surface LS along an auxiliary scanning direction perpendicular to the main scanning direction.

The electrification device 4 is disposed to face the electrostatic latent image holding surface LS. The electrification device 4, which is of a corotron type or a scorotron type, is configured to evenly and positively charge the electrostatic latent image holding surface LS.

The scanning unit 5 is configured to generate a laser beam LB modulated based on image data. Specifically, the scanning unit 5 is configured to generate the laser beam LB within a predetermined wavelength range, which laser beam LB is emitted under ON/OFF control depending on whether there is a pixel in a target location on the image data.

In addition, the scanning unit 5 is configured to converge the laser beam LB in a scanned position SP on the electrostatic latent image holding surface LS. Here, the scan position SP is set in a position downstream relative to the electrification device 4 in the rotational direction of the photoconductive drum 3 (i.e., the clockwise direction indicated by the arrows in FIG. 1).

Further, the scanning unit 5 is configured to form the electrostatic latent image on the electrostatic latent image holding surface LS while moving (scanning) a position, where the laser beam LB is converged on the electrostatic latent image holding surface LS, along the main scanning direction at a constant speed.

The toner supply device 6 is disposed under the photoconductive body 3 so as to face the photoconductive body 3. The toner supply device 6 is configured to supply the charged toner T (see FIG. 2), in a development position DP, onto the photoconductive drum 3 (the electrostatic latent image holding surface LS). It is noted that the development position DP denotes a position where the toner supply device 6 faces the electrostatic latent image holding surface LS in closest proximity thereto. A detailed explanation will be provided later about the configuration of the toner supply device 6.

Subsequently, a detailed explanation will be provided about a specific configuration of each element included in the laser printer 1.

The sheet feeding mechanism 2 includes a pair of registration rollers 21, and a transfer roller 22.

The registration rollers 21 are configured to feed a sheet P toward between the photoconductive drum 3 and the transfer roller 22 at a predetermined moment.

The transfer roller 22 is disposed to face the electrostatic latent image holding surface LS (i.e., the outer circumferential surface of the photoconductive drum 3) across the sheet P in a transfer position TP. Additionally, the transfer roller 22 is driven to rotate in a counterclockwise direction indicated by an arrow in FIG. 1.

The transfer roller 22 is connected to a bias power supply circuit (not shown). Specifically, the transfer roller 22 is configured such that a predetermined transfer bias voltage is applied between the transfer roller 22 and the photoconductive drum 3 so as to transfer, onto the sheet P, the toner T (see FIG. 2) which adheres onto the electrostatic latent image holding surface LS.

<<Toner Supply Device>>

Figure 2:
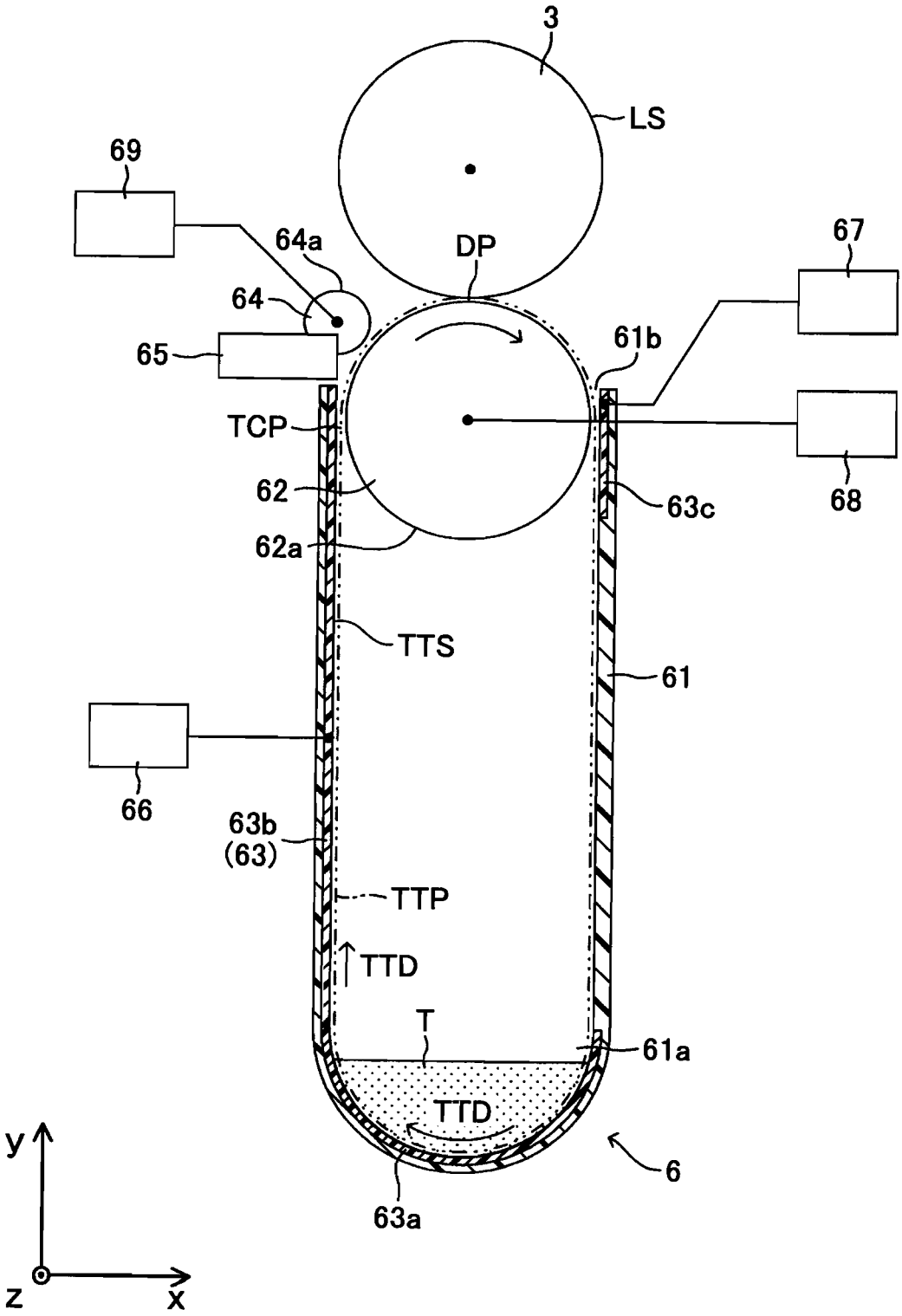
FIG. 2 is an enlarged cross-sectional side view of a toner supply device for the laser printer in the embodiment according to one or more aspects of the present invention.

As depicted in FIG. 2 that is a cross-sectional side view (a cross-sectional view along a plane with the main scanning direction as a normal line) of the toner supply device 6, a toner box 61, which forms a casing of the toner supply device 6, is a box member that is formed substantially in a U-shape when viewed in the z-axis direction. Further, the toner box 61 is disposed to have a longitudinal direction parallel to an up-to-down (vertical) direction (i.e., the y-axis direction in FIG. 2).

The toner box 61 is configured to accommodate the toner T (powdered dry-type development agent). Specifically, the toner T is stored in a toner storage section 61*a* that is a space formed inside a substantially half-cylinder-shaped bottom section of the toner box 61. It is noted that in the embodiment, the toner T is positively-chargeable nonmagnetic-one-component black toner. Further, the toner box 61 has an opening 61*b* formed in such a position at a top of the toner box 61 as to face the photoconductive drum 3. In other words, the opening 61*b* is opened up toward the photoconductive drum 3.

The development roller 62 is a roller-shaped member having a toner holding surface 62*a* that is a cylindrical circumferential surface. The development roller 62 is disposed to face the photoconductive drum 3. Specifically, the development roller 62 is disposed such that the toner holding surface 62*a* thereof faces the electrostatic latent image holding surface LS of the photoconductive drum 3 in the development position DP across a predetermined gap.

The development roller 62 is rotatably supported at an upper end portion of the toner box 61 where the opening 61*b* is formed. In the embodiment, the development roller 62 is housed in the toner box 61 such that a rotational central axis, parallel to the main scanning direction, of the development roller 62 is located inside the toner box 61 and thereby substantially an upper half of the toner holding surface 62*a* is exposed to the outside of the toner box 61.

Inside the toner box 61, a transfer board 63 is provided along a toner transfer path TTP that is formed substantially in the shape of an ellipse with a longitudinal direction extending in the vertical direction (i.e., in the y-axis direction in FIG. 2) when viewed in the z-axis direction. The transfer board 63 is fixed onto an inner wall surface of the toner box 61. The transfer board 63 is configured to transfer the toner T with a traveling-wave electric field, on a toner transfer surface TTS along the toner transfer path TTP. In the embodiment, the transfer board 63 includes a bottom transfer board 63*a*, a vertical transfer board 63*b*, and a retrieving board 63*c*. It is noted that a detailed explanation will be provided later about an internal configuration of the transfer board 63 (the bottom transfer board 63*a*, the vertical transfer board 63*b*, and the retrieving board 63*c*).

The bottom transfer board 63*a* is fixed onto the inner wall surface of the toner box 61 in a bottom region of an inner space of the toner box 61. The bottom transfer board 63*a* is a hollow-shaped bent plate member that is bent in the shape of a half-cylinder open up when viewed in the z-axis direction as shown in FIG. 2. Further, the bottom transfer board 63*a* is smoothly connected with a lower end of the flat-plate vertical transfer board 63*b*, so as to smoothly transfer the toner T stored in the toner storage section 61*a* toward the lower end of the vertical transfer board 63*b*.

The vertical transfer board 63*b* is fixed onto the inner wall surface of the toner box 61. The vertical transfer board 63*b* is vertical provided to transfer the toner T vertically upward from the lower end of the vertical transfer board 63*b* that is connected with the bottom transfer board 63*a*. The vertical transfer board 63*b* has an upper end provided to be substantially as high as a center of the development roller 62 (more specifically, the upper end is provided up to a point slightly higher than the center of the development roller 62). The upper end of the vertical transfer board 63*b* faces the toner holding surface 62*a* as a cylindrical surface of the development roller 62. There is a gap of a predetermined distance between the upper end of the vertical transfer board 63*b* and the toner holding surface 62*a*, in a toner carrying position TCP where the upper end of the vertical transfer board 63*b* and the toner holding surface 62*a* face each other in closest proximity to each other.

In the embodiment, the bottom transfer board 63*a* and the vertical transfer board 63*b* are formed in the shape of a mirror-reversed character "J," integrally in a seamless manner. The vertical transfer board 63*b* is configured to transfer the toner T received from the bottom transfer board 63*a* in a toner transfer direction TTD toward the toner carrying position TCP which is located upstream relative to the development position DP in the moving direction of the toner holding surface 62*a* (it is noted that the toner transfer direction TTD is a tangential direction of the toner transfer path TTP).

The retrieving board 63*c* is disposed to face the development roller 62 on a side opposite to the upper end of the vertical transfer board 63*b* across the development roller 62 (in other words, to face the upper end of the vertical transfer board 63*b* across the development roller 62). Namely, the retrieving board 63*c* is disposed downstream relative to the opening 61*b* of the toner box 61 in the toner transfer direction TTD. In the embodiment, a terminal end of the retrieving board 63*c* in the toner transfer direction TTD is disposed in a position corresponding to a lower end of the development roller 62. The retrieving board 63*c* is configured to retrieve, from the development roller 62, the toner T that has not been consumed in the development position DP and transfer the retrieved toner T down to the toner storage section 61*a*. Specifically, in the embodiment, the retrieving board 63*c*, which is formed in a flat plate shape, faces the development roller 62 across a gap of a predetermined distance (which is narrower than the gap in the development position DP between the photoconductive drum 3 and the development roller 62), so as to transfer the toner T downward in the vertical direction.

A facing member 64 is disposed to face the toner holding surface 62*a* in a position between the toner carrying position and the development position DP in the moving direction of the toner holding surface 62*a*. The facing member 64 is configured to charge the toner T held on the toner holding surface 62*a* by the action of an alternating electric field generated between the facing member 64 and the toner holding surface 62*a*. In the embodiment, the facing member 64 is a roller having a central axis parallel to the main scanning direction, and driven to rotate around the central axis. There is a gap of a predetermined distance between the facing member 64 (more specifically, a facing roller surface 64*a* of the facing member 64 that faces the toner holding surface 62*a*) and the toner holding surface 62*a*.

Further, the toner supply device 6 is provided with a cleaner 65. The cleaner 65 is configured to remove, from the facing roller surface 64*a*, the toner T adhering to the facing roller surface 64*a* as a cylindrical circumferential surface of the facing member 64.

Figure 3:
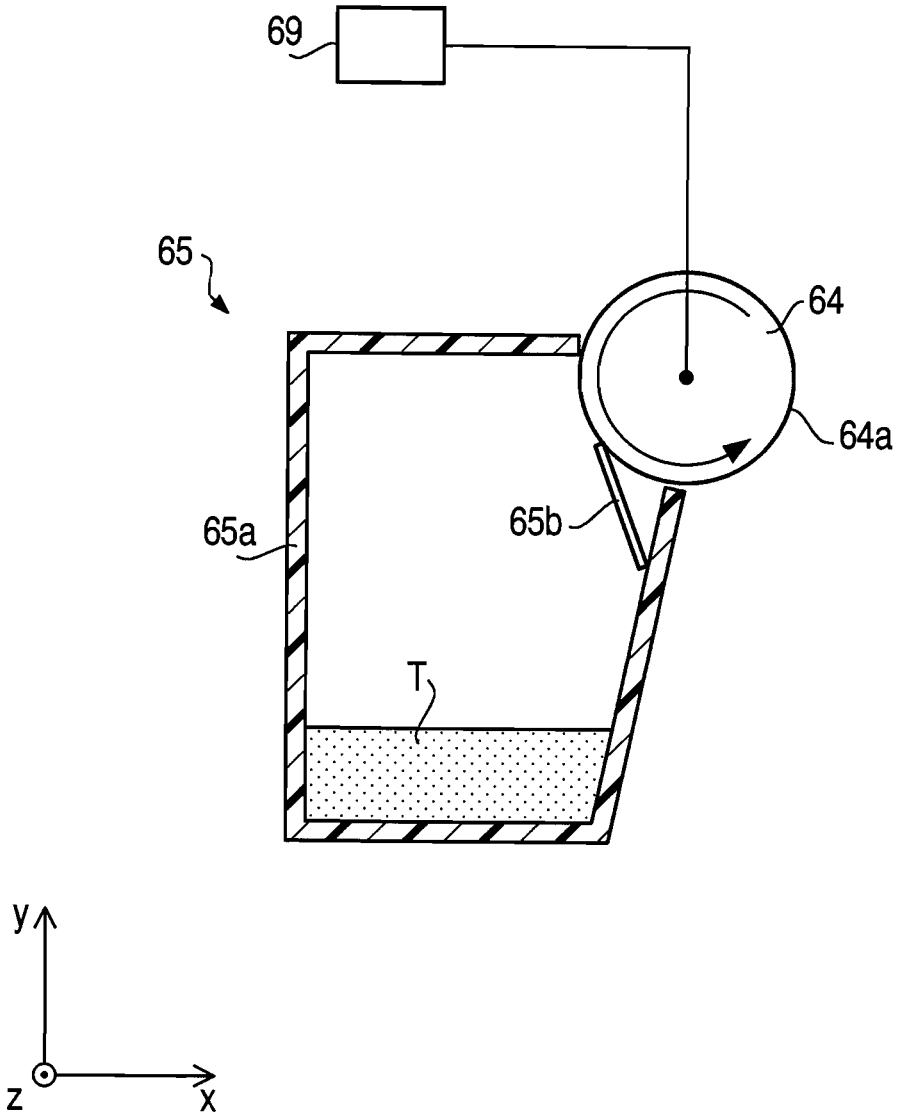
FIG. 3 is an enlarged cross-sectional side view of a cleaner for the toner supply device in the embodiment according to one or more aspects of the present invention.

Referring to FIG. 3, the cleaner 65 includes a cleaner case 65*a* and a cleaning blade 65*b*.

The cleaner case 65*a* is a box-shaped member formed from insulating synthetic resin, and disposed to face the facing member 64. The cleaner case 65*a* has an opening provided in such a position as to face the facing member 64. The opening is provided to cover the entire length of the facing member 64 in the main scanning direction (a sheet width direction), so as to accommodate a part of the facing roller surface 64*a*. Namely, the cleaner case 65*a* is configured to accommodate a part of the facing member 64 over the entire length of the facing member 64 in the main scanning direction (the sheet width direction).

The cleaning blade 65*b* is housed in the cleaner case 65*a*. The cleaning blade 65*b* is configured to remove (scrape off) the toner T from the part of the facing member 64 that is housed in the cleaner case 65*a* while sliding in contact with the housed part. Specifically, a base end of the cleaning blade 65*b* is supported by the cleaner case 65*a*. Further, the cleaning blade 65*b* is disposed such that a distal end thereof protrudes from the base end thereof in a direction opposite to a moving direction in which the facing roller surface 64*a* moves when the facing member 64 is driven to rotate in a cleaning operation after completion of an image forming operation, and thereby establishes so-called "counter contact" with the facing roller surface 64*a*.

Referring back to FIG. 2, in the transfer board 63, the bottom transfer board 63*a* and the vertical transfer board 63*b* are electrically connected with a transfer power-supply circuit 66. The retrieving board 63*c* is electrically connected with a retrieval power-supply circuit 67. The development roller 62 is electrically connected with a development bias power-supply circuit 68.

The transfer power-supply circuit 66, the retrieval power-supply circuit 67, and the development bias power-supply circuit 68 are configured to output voltages required for circulating the toner T in the toner transfer direction TTD along the toner transfer path TTP (more specifically, having the development roller 62 once hold the toner T stored in the toner storage section 61*a* to supply the toner T to the development position DP, and retrieving, from the development roller 62, the toner T, which has not been consumed in the development position DP, to return the unconsumed toner T down to the toner storage section 61*a*).

Namely, the transfer power-supply circuit 66 and the retrieval power-supply circuit 67 are configured to output below-mentioned transfer bias voltages containing multi-phase alternating-current (AC) voltage components so as to form traveling-wave electric fields to transfer the toner T in the toner transfer direction TTD on the toner transfer surface TTS. Additionally, the development bias power-supply circuit 68 is configured to output a voltage (typically, a development bias voltage having a direct-current (DC) voltage component and an AC voltage component) required for the following operations: having the toner holding surface 62*a* hold the toner T in the toner holding position TCP, transferring the toner T from the toner holding surface 62*a* to an electrostatic latent image on the electrostatic latent image holding surface LS in accordance with an electric potential distribution formed on the electrostatic latent image holding surface LS, and transferring to the retrieving board 63*c* the toner T left on the toner holding surface 62*a* that has passed through the development position DP.

The facing member 64 is electrically connected with a charge bias power-supply circuit 69. The charge bias power-supply circuit 69 is configured to charge the toner T held on the toner holding surface 62*a*, by the action of an alternating electric field that is generated in a position where the development roller 62 (the toner holding surface 62*a*) faces the facing member 64 (the facing roller surface 64*a*). Specifically, the charge bias power-supply circuit 69 is configured to output a charge bias voltage containing only a DC voltage component so as to generate an alternating electric field between the development roller 62 and the facing member 64 with the AC voltage component generated by the aforementioned development bias power-supply circuit 68. In other words, the development bias power-supply circuit 68 and the charge bias power-supply circuit 69 are configured such that substantially AC voltage is applied between the development roller 62 and the facing member 64.

Specifically, in the embodiment, the transfer power-supply circuit 66 is configured to output a transfer bias voltage (+500 V to +1100 V) containing a DC voltage component of +800 V and a multi-phase AC voltage component with an amplitude of 300 V and a frequency of 300 Hz. The retrieval power-supply circuit 67 is configured to output a retrieving bias voltage (−200 V to +400 V) containing a DC voltage component of +100 V and a multi-phase AC voltage component with an amplitude of 300 V and a frequency of 300 Hz. The development bias power-supply circuit 68 is configured to output a transfer bias voltage (−500 V to +1500 V) containing a DC voltage component of +500 V and a multi-phase AC voltage component with an amplitude of 1000 V and a frequency of 1 kHz. The charge bias power-supply circuit 69 is configured to output a charge bias voltage containing only a DC voltage component of +600 V.

<<<Internal Configuration of Transfer Board>>>

Figure 4:
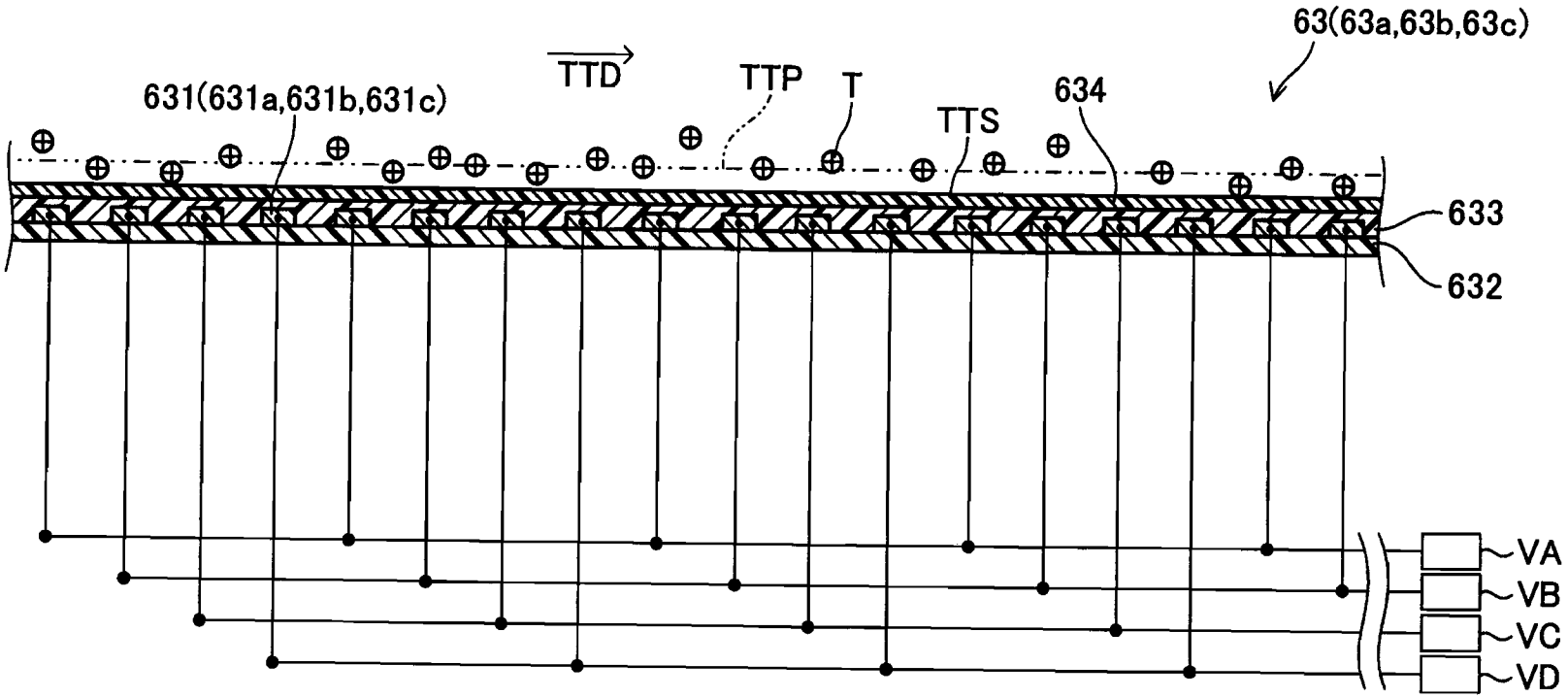
FIG. 4 is an enlarged cross-sectional side view of a transfer board for the toner supply device in the embodiment according to one or more aspects of the present invention.

Referring to FIG. 4, the transfer board 63 is a thin plate member configured in the same manner as a flexible printed-circuit board. Specifically, the transfer board 63 includes a plurality of transfer electrodes 631, a transfer electrode supporting film 632, a transfer electrode coating layer 633, and a transfer electrode overcoating layer 634.

The transfer electrodes 631 include bottom transfer electrodes 631*a* for the bottom transfer board 63*a*, vertical transfer electrodes 631*b* for the vertical transfer board 63*b*, and retrieving electrodes 631*c* for the retrieving board 63*c*. The transfer electrodes 631 are linear wiring patterns elongated in a direction parallel to the main scanning direction. The transfer electrodes 631 are formed with copper thin films. The transfer electrodes 631 are arranged along the toner transfer path TTP so as to be parallel to each other.

Every four ones of the transfer electrodes 631, arranged along the toner transfer path TTP, are connected in common with a specific one of four power supply circuits VA, VB, VC, and VD. In other words, the transfer electrodes 631 are arranged along the toner transfer path TTP in the following order: a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, . . . (it is noted that the power supply circuits VA, VB, VC, and VD are included in the transfer power-supply circuit 66 shown in FIG. 2).

FIG. 5 exemplifies output waveforms, which are respectively generated by the power supply circuits VA, VB, VC, and VD shown in FIG. 4. In the embodiment, as illustrated in FIG. 5, the power supply circuits VA, VB, VC, and VD are configured to generate respective AC driving voltages having substantially the same waveform. Further, the power supply circuits VA, VB, VC, and VD are configured to generate the respective AC driving voltages with a phase difference of 90 degrees between any adjacent two of the power supply circuits VA, VB, VC, and VD in the aforementioned order. In other words, the power supply circuits VA, VB, VC, and VD are configured to output the respective AC driving voltages each of which is delayed by a phase of 90 degrees behind the voltage output from a precedent adjacent one of the power supply circuits VA, VB, VC, and VD in the aforementioned order. Thus, the transfer board 63 is configured to transfer the positively charged toner T in the toner transfer direction TTD when the aforementioned diving voltages (the transfer bias voltages or the retrieving bias voltage) are applied to the transfer electrodes 631 and traveling-wave electric fields are generated along the toner transfer surface TTS.

The transfer electrodes 631 are formed on a surface of the transfer electrode supporting film 632. The transfer electrode supporting film 632 is a flexible film made of electrically insulated synthetic resin such as polyimide resin. The transfer electrode coating layer 633 is made of electrically insulated synthetic resin. The transfer electrode coating layer 633 is provided to coat the transfer electrodes 631 and a surface of the transfer electrode supporting film 632 on which the transfer electrodes 631 are formed. On the transfer electrode coating layer 633, the transfer electrode overcoating layer 634 is provided. Namely, the transfer electrode coating layer 633 is formed between the transfer electrode overcoating layer 634 and the transfer electrodes 631. The surface of the transfer electrode overcoating layer 634 (i.e., the toner transfer surface TTS) is formed as a smooth surface with a very low level of irregularity, so as to smoothly convey the toner T.

<Operations of Laser Printer>

Subsequently, a general overview will be provided of operations of the laser printer configured as above with reference to the relevant drawings.

<<Sheet Feeding Operation>>

Referring to FIG. 1, firstly, a leading end of a sheet P placed on the feed tray (not shown) is conveyed to the registration rollers 21. The registration rollers perform skew correction for the sheet P, and adjust a moment when the sheet P is to be fed forward. After that, the sheet P is fed to the transfer position TP.

<<Formation of Toner Image on Electrostatic Latent Image Holding Surface>>

While the sheet P is being conveyed to the transfer position TP as described above, an image of the toner T (hereinafter referred to as a toner image) is formed on the electrostatic latent image holding surface LS that is the outer circumferential surface of the photoconductive drum 3, as will be mentioned below.

<<Formation of Electrostatic Latent Image>>

Firstly, the electrostatic latent image holding surface LS of the photoconductive drum 3 is charged evenly and positively by the electrification device 4. The electrostatic latent image holding surface LS, charged by the electrification device 4, is moved along the auxiliary scanning direction to the scanned position SP to face the scanning unit 5, when the photoconductive drum 3 rotates in the clockwise direction shown by arrows in FIG. 1.

In the scanned position SP, the electrostatic latent image holding surface LS is exposed to the laser beam LB that is modulated based on the image data. Namely, while being scanned along the main scanning direction, the laser beam LB is rendered incident onto the electrostatic latent image holding surface LS. In accordance with the modulation of the laser beam LB, areas with no positive charge remaining thereon are generated on the electrostatic latent image holding surface LS. Thereby, an electrostatic latent image is formed with a positive charge pattern (positive charges distributed in the shape of an image) on the electrostatic latent image holding surface LS. The electrostatic latent image, formed on the electrostatic latent image holding surface LS, is transferred to the development position DP to face the toner supply device 6 when the photoconductive drum 3 rotates in the clockwise direction indicated by the arrows in FIG. 1.

<<Transfer and Supply of Charged Toner>>

Referring to FIGS. 2 and 4, the toner T stored in the toner box 61 is charged due to contact or friction with the transfer electrode overcoating layer 634 on the bottom transfer board 63*a*. The charged toner T, which is in contact with or proximity to the transfer electrode overcoating layer 634 on the bottom transfer board 63*a*, is conveyed in the toner transfer direction TTD, by the traveling-wave electric field generated when the aforementioned transfer bias voltage, containing the multi-phase AC voltage component, is applied to the bottom transfer electrodes 631*a*. Thereby, the charged toner T is smoothly transferred to the vertical transfer board 63*b*.

The vertical transfer board 63*b* conveys the toner T, received at the lower end thereof from the bottom transfer board 63*a*, vertically upward in the toner transfer direction TTD, by the traveling-wave electric field generated when the aforementioned transfer bias voltage is applied to the vertical transfer electrodes 631*b*. Here, the toner T transferred from the bottom transfer board 63*a* to the vertical transfer board 63*b* contains toner charged in an undesired manner as well (e.g., negatively charged toner, inadequately charged toner, and uncharged toner).

Nonetheless, in the embodiment, inappropriately charged toner deviates from the toner transfer path TTP and drops from the vertical transfer board 63*b* by the action of the gravity and/or the aforementioned electric fields, when being conveyed by the vertical transfer board 63*b* vertically up toward the toner carrying position TCP, or being held on the development roller 62 in the toner carrying position TCP by the electric field generated between the vertical transfer board 63*b* and the development roller 62. Thereby, it is possible to selectively convey adequately charged toner T to the toner carrying position TCP. Namely, it is possible to discriminate adequately charged toner T from inappropriately charged toner T by the vertical transfer board 63*b*, in a preferred manner. The toner T, which has deviated from the toner transfer path TTP and dropped, returns into the toner storage section 61*a*.

In the aforementioned manner, the positively charged toner T is transferred to the toner carrying position TCP by the vertical transfer board 63*b*. During this time, a charged level of the toner T gradually rises. Namely, in the embodiment, the toner T is charged by the action of the aforementioned transfer bias voltages, on the bottom transfer board 63*a* as an upstream end of the transfer board 63 in the toner transfer direction TTD (particularly, around a top surface of the toner T stored in the toner storage section 61*a*), and in an area from the lower end of the vertical transfer board 63*b* to the toner carrying position TCP.

The toner T, transferred to the toner carrying position TCP by the vertical transfer board 63*b*, is held and carried on the toner holding surface 62*a* in the toner carrying position TCP, by the action of the transfer bias voltages and the development bias voltage. Then, when the development roller 62 is driven to rotate and the toner holding surface 62*a* moves to the development position DP, the toner T is supplied to the development position DP. Around the development position DP, the electrostatic latent image formed on the electrostatic latent image holding surface LS is developed with the toner T by the action of the development bias voltage. Namely, from the toner holding surface 62*a*, the toner T is transferred and adheres to the areas with no positive charge on the electrostatic latent image holding surface LS. Thereby, the toner image is formed and held on the electrostatic latent image holding surface LS.

The toner T on the toner holding surface 62*a*, which has passed through the development position DP without being consumed, is transferred to the retrieving board 63*c* by the action of the aforementioned development bias voltage and retrieving bias voltage. Thus, the unconsumed toner T is retrieved from the toner holding surface 62*a* by the retrieving board 63*c*.

The inventors of the present invention has found a problem of a known toner supply device of this kind, i.e., undesired efficiency in transferring the toner T from the toner holding surface 62*a* to the electrostatic latent image holding surface LS (in other words, development efficiency or efficiency in supplying the toner T). The problem is considered to be caused due to the toner T too firmly adhering onto the toner holding surface 62*a*.

Figure 6A:
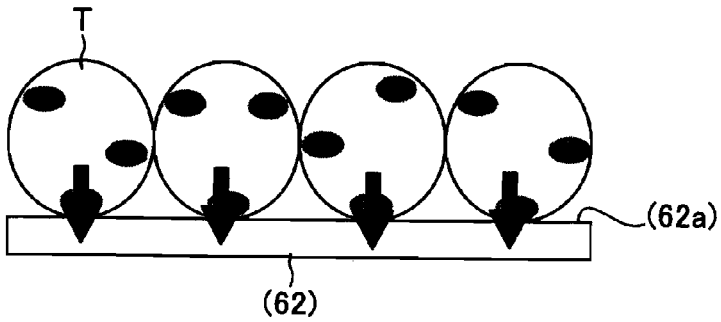
Figure 6B:
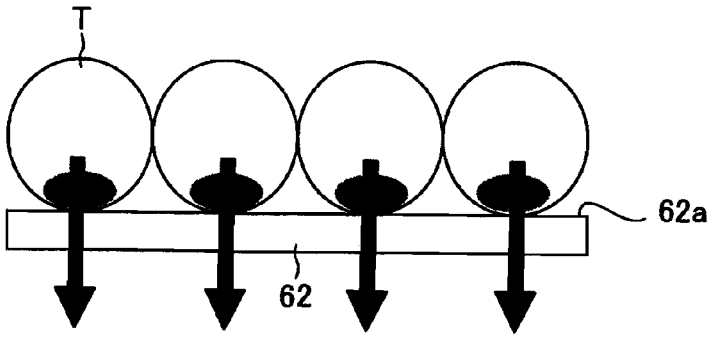

As illustrated in FIG. 6A, in a usual nonmagnetic-one-component development device (a device configured to make the development roller 62 hold thereon the charged toner T with a sponge roller or a blade), as the toner T is charged by friction between the development roller 62 and the sponge roller or the blade, it is assumed that charged positions (see gray filled portions in FIG. 6A) in the toner T are evenly dispersed. Meanwhile, as depicted in FIG. 6B, in the known toner supply device of this kind, it is assumed that charged positions in the toner T are localized (i.e., specific portions in the toner T are charged in a localized manner) for the following reason. Accordingly, in the state as shown in FIG. 6B, an electrostatic adhering force of the toner T is considered to be stronger (see downward arrows in FIG. 6B), in comparison with the state as shown in FIG. 6A.

Figure 6C:
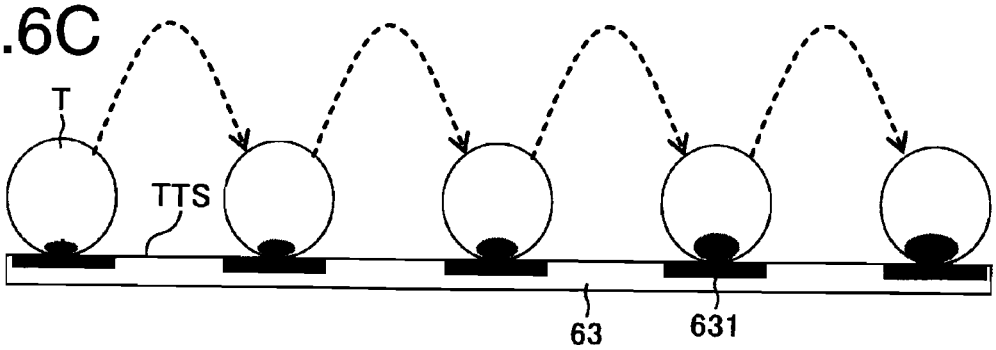

As illustrated in FIG. 6C, when transferred under the electric fields on the transfer board 63, the toner T travels while hopping along a loop electric flux line (see a dashed line in FIG. 6C). At this time, the toner T (each particle of the powdered toner T) hops with a specific charged position (i.e., the most charged position) thereof as a leading head. Therefore, the specific position of the toner T collides with the toner transfer surface TTS in the most frequent manlier, and is friction-charged. Thus, the specific position is charged up in a localized manner when transferred under the electric fields on the transfer board 63.

Figure 6D:
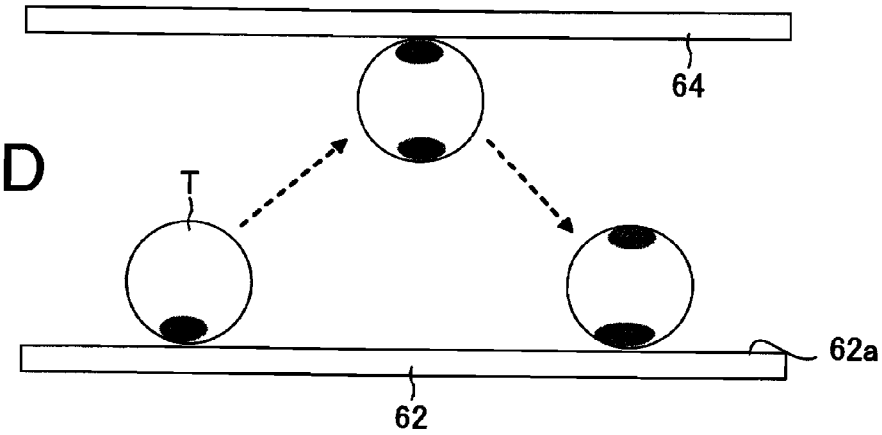

On the contrary, in the embodiment, the toner T, which is once held in a charged state as shown in FIG. 6B near the toner carrying position TCP on the toner holding surface 62*a*, is charged by the action of the alternating electric field as shown in FIG. 6D, in the position where the development roller 62 faces the facing member 64. It is noted that in the embodiment, rotation of the facing member 64 is stopped during the image forming operation, i.e., the aforementioned operation of charging the toner T.

By charging the toner T under the alternating electric field, the toner T is more evenly charged. Specifically, by charging the toner T as illustrated in FIG. 6D, after passing through the position where the development roller 62 faces the facing member 64, the toner T is brought into a state where charged positions thereof are evenly dispersed as shown in FIG. 6A. Thereby, the adhering force of the toner T on the toner holding surface 62*a* is lowered in comparison with the known toner supply device (see FIG. 6B). Accordingly, according to the embodiment, development efficiency in the development position DP is enhanced. Thus, retrieval efficiency in retrieving the toner T by the retrieving board 63*c* is improved as well.

The toner T, transferred to the retrieving board 63*c* in a preferred manner, is conveyed vertically downward by the action of the aforementioned retrieving bias voltage. At the lower end of the retrieving board 63*c*, an inertia force acts on the toner T in the same direction as the gravity. Therefore, in a position lower than the lower end of the retrieving board 63*c*, the toner T drops into the toner storage section 61*a* by the actions of the gravity and the inertia force in the same direction as the gravity. Thus, even though the retrieving board 63*c* is not provided up to the toner storage section 61*a*, it is possible to return the toner T into the toner storage section 61*a* in a preferred manner.

The toner, which adheres to the facing roller surface 64*a* in the aforementioned operation of charging the toner T with the facing member 64, is removed from the facing roller surface 64*a* by the cleaner 65. Specifically, in the cleaning operation after the image forming operation, the facing member 64 is driven to rotate. Then, the cleaning blade 65*b* slides in contact with the facing roller surface 64*a*. Thereby, the toner T adhering onto the facing roller surface 64*a* is scraped off from the facing roller surface 64*a*, and put into the cleaner case 65*a*.

<<Transfer of Toner Image from Electrostatic Latent Image Holding Surface onto Sheet>>

Referring to FIG. 1, the toner image, which is held on the electrostatic latent image holding surface LS of the photoconductive drum 3 as described above, is conveyed to the transfer position TP when the electrostatic latent image holding surface LS turns in the clockwise direction shown by the arrows in FIG. 1. Then, in the transfer position TP, the toner image is transferred from the electrostatic latent image holding surface LS onto the sheet P.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

Aspects of the present invention may be applied to electrophotographic image forming devices such as color laser printers, and monochrome and color copy machines, as well as the single-color laser printer as exemplified in the aforementioned embodiment. Further, the photoconductive body is not limited to the drum-shaped one as exemplified in the aforementioned embodiment. For instance, the photoconductive body may be formed in the shape of a plate or an endless belt. Additionally, light sources (e.g., LEDs, electroluminescence devices, and fluorescent substances) other than a laser scanner may be employed as light sources for exposure. In such cases, the "main scanning direction" may be parallel to a direction in which light emitting elements such as LEDs are aligned. Furthermore, aspects of the present invention may be applied to image forming devices employing methods other than the aforementioned electrophotographic method (e.g., a toner-jet method using no photoconductive body, an ion flow method, and a multi-stylus electrode method).

Referring to FIG. 5, the voltages generated by the power supply circuits VA, VB, VC, and VD may have an arbitrary waveform (e.g., a sinusoidal waveform and a triangle waveform) other than the rectangle waveform as exemplified in the aforementioned embodiment. Further, in the aforementioned embodiment, the four power supply circuits VA, VB, VC, and VD are provided to generate the respective alternating-current driving voltages with a phase difference of 90 degrees between any adjacent two of the power supply circuits VA, VB, VC, and VD in the aforementioned order. However, three power supply circuits may be provided to generate respective AC driving voltages with a phase difference of 120 degrees between any two of the three power supply circuits.

The aforementioned various bias voltages may be changed. Specifically, for instance, the development bias voltage (i.e., the voltage applied to the development roller 62) may only contain a DC voltage component (including the voltage level of ground). In this case, the other bias voltages may be changed as needed in response to the change of the development bias voltage.

The photoconductive drum 3 and the development roller 62 may contact each other.

The configuration and location of the transfer board 63 are not limited to those exemplified in the aforementioned embodiment. For instance, the transfer board 63 may be configured to contact the development roller.

The transfer board 63 may be configured without the transfer electrode overcoating layer 634. Alternatively, the transfer board 63 may be configured with the transfer electrodes 631 implanted in the transfer electrode supporting film 632. In this case, the transfer board 63 may be configured without the transfer electrode coating layer 633 or the transfer electrode overcoating layer 634.

A central portion of the bottom transfer board 63*a* may be flat. Namely, the bottom transfer board 63*a* may have curved surface portions only at the joint where the bottom transfer board 63*a* is connected with the lower end of the vertical transfer board 63*b*.

The bottom transfer board 63*a* may be configured to be separate from the vertical transfer board 63*b*. In this case, the bottom transfer board 63*a* and the vertical transfer board 63*b* may be connected with respective different power supplies.

The vertical transfer board 63*b* may be slightly tilted as long as it extends substantially along the up-to-down direction. The retrieving board 63*c* may be slightly tilted as well. The retrieving board 63*c* may extend up to the toner storage section 61*a*, so as to be connected with the bottom transfer board 63*a*.

The toner supply device 6 according to aspects of the present invention may not have to be configured to charge the toner T by the entire transfer path, up to the toner carrying position TCP, which includes the bottom transfer board 63*a* and the vertical transfer board 63*b*. For instance, when the transfer electrode overcoating layer 634 for the vertical transfer board 63*b* is made of appropriately selected material, the toner T, which is being conveyed on the vertical transfer board 63*b*, may be prevented as efficiently as possible from being charged up. In this case, the toner T may be charged mainly at an upstream end of the toner transfer path TTP (i.e., on the bottom transfer board 63*a*). Even in this case, when the toner T is charged in the position where the development roller 62 faces the facing member 64 by the action of the alternating electric field, it is possible to reduce as efficiently as possible the ratio of the inadequately charged toner T (e.g., uncharged or low-charged toner T) in the development position DP.

The cleaner 65 may include a brush roller, instead of the cleaning blade 65*b* exemplified in the aforementioned embodiment.

As depicted in FIG. 7, the cleaner 65, of a modification according to aspects of the present invention, may include a cleaning board 65*c*.

The cleaning board 65*c* is disposed in the cleaner case 65*a* to face a part of the facing roller surface 64*a* which part is housed inside the cleaner case 65*a*. The cleaning board 65*c* is configured in the same fashion as the transfer board 63. Specifically, the cleaning board 65*c* includes a plurality of cleaning electrodes 65*c*1 arranged along a cleaning path CP perpendicular to the main scanning direction.

The cleaning board 65*c* is configured to, when a cleaning bias voltage is applied to the plurality of cleaning electrodes 65*c*1 by a cleaning bias power-supply circuit 691, pull the toner T away from the facing roller surface 64*a* near a cleaning position CPO and transfer the toner T from the cleaning position CPO toward a bottom of the cleaner case 65*a*. It is noted that the cleaning bias voltage contains a multi-phase AC voltage component. Further, in the cleaning position CPO, the cleaning board 65*c* faces the facing member 64 in closest proximity to the facing member 64 across a predetermined distance of gap.

In this case, the charge bias power-supply circuit 69 is configured to output a bias voltage (−800 V to +1800 V) containing a DC voltage component of +500 V and a multi-phase AC voltage component with an amplitude of 1300 V and a frequency of 2 kHz. Further, the cleaning bias power-supply circuit 691 is configured to output a bias voltage (−300 V to +300 V) containing a DC voltage component of 0 V and a multi-phase AC voltage component with an amplitude of 300 V and a frequency of 300 Hz.

As shown in FIG. 8, the facing member 64 may be configured to be a thin plate member or a thin film member that is bent substantially in an arc shape along an outer shape of the toner holding surface 62*a* when viewed in the z-axis direction. In this configuration, it is possible to ensure a longer length of the facing member 64 along the toner transfer path TTP in an area where an alternating electric field is applied to the toner T between development roller 62 and the facing member 64. Thereby, it is possible to more evenly charge the toner T.

In this case, as illustrated in FIG. 8, the facing member 64 may be formed integrally with the transfer board 63. Specifically, the facing member 64 may be formed in the same manner as the transfer electrodes 631 of the transfer board 63

(see FIG. 4). Alternatively, the facing member 64 may be formed separately from the transfer board 63, so as to make it easy to adjust a gap between the development roller 62 and the facing member 64.

Further, it is desired to make the distance between the photoconductive drum 3 and the facing member 64 longer than that between the development roller 62 and the facing member 64, and to make the distance between the photoconductive drum 3 and the facing member 64 longer than that between the photoconductive drum 3 and the development roller 62. According to the above configuration, it is possible to prevent the toner T from jumping from the facing member 64 directly to the photoconductive drum 3.

What is claimed is:

1. A development agent supply device configured to supply charged development agent to an intended device, comprising:

a development agent holding member that comprises a development agent holding surface that is formed to be a cylindrical circumferential surface parallel to a first direction and disposed to face the intended device in a first position, the development agent holding member being configured to rotate around an axis parallel to the first direction such that the development agent holding surface moves in a second direction perpendicular to the first direction;

a transfer board provided along a development agent transfer path perpendicular to the first direction, the transfer board being configured to charge development agent on the development agent transfer path and transfer the charged development agent along the development agent transfer path to a second position where the transfer board faces the development agent holding surface in closest proximity to the development agent holding surface, such that the charged development agent is transferred to and held on the development agent holding surface in the second position; and a facing member disposed to face the development agent holding surface in a position between the first position and the second position in the second direction, the facing member being configured to charge the development agent held on the development agent holding surface under an alternating electric field generated between the facing member and the development agent holding member, the facing member is applied with a single voltage.

2. The development agent supply device according to claim 1, wherein the transfer board comprises a plurality of transfer electrodes arranged along the development agent transfer path, and wherein the transfer board is configured to, when a bias voltage containing a multi-phase alternating-current voltage component is applied to the plurality of transfer electrodes, generate a traveling-wave electric field along the development agent transfer path, and charge and transfer the development agent by the traveling-wave electric field on the development agent transfer path.

3. The development agent supply device according to claim 1, wherein the facing member is configured to rotate around an axis parallel to the first direction.

4. The development agent supply device according to claim 1, wherein the facing member is formed in an arc shape along an outer shape of the development agent holding surface when viewed in the first direction.

5. The development agent supply device according to claim 4, wherein the facing member is formed integrally with the transfer board.

6. The development agent supply device according to claim 1, further comprising a cleaner configured to remove, from the facing member, development agent adhering to the facing member.

7. The development agent supply device according to claim 6, wherein the cleaner comprises a cleaning blade that is disposed to contact the facing member and configured to scrape the development agent adhering to the facing member off from the facing member.

8. The development agent supply device according to claim 6, wherein the cleaner comprises a cleaning board disposed to face the facing member, wherein the cleaning board comprises a plurality of cleaning electrodes arranged along a cleaning path perpendicular to the first direction, and wherein the cleaning board is configured to, when a bias voltage containing a multi-phase alternating-current voltage component is applied to the plurality of cleaning electrodes, remove from the facing member the development agent adhering to the facing member near a third position where the cleaning board faces the facing member and convey the removed development agent along the cleaning path.

9. The development agent supply device according to claim 1, wherein the single voltage is a direct-current (DC) voltage, and wherein the development agent holding member is applied with an alternating-current (AC) voltage.

10. An image forming apparatus comprising:

a photoconductive body configured such that a development agent image is formed thereon; and a development agent supply device configured to supply charged development agent to the photoconductive body, wherein the development agent supply device comprises:

a development agent holding member that comprises a development agent holding surface that is formed to be a cylindrical circumferential surface parallel to a first direction and disposed to face the photoconductive body in a first position, the development agent holding member being configured to rotate around an axis parallel to the first direction such that the development agent holding surface moves in a second direction perpendicular to the first direction;

a transfer board provided along a development agent transfer path perpendicular to the first direction, the transfer board being configured to charge development agent on the development agent transfer path and transfer the charged development agent along the development agent transfer path to a second position where the transfer board faces the development agent holding surface in closest proximity to the development agent holding surface, such that the charged development agent is transferred to and held on the development agent holding surface in the second position; and a facing member disposed to face the development agent holding surface in a position between the first position and the second position in the second direction, the facing member being configured to charge the development agent held on the development agent holding surface under an alternating electric field generated between the facing member and the development agent holding member, the facing member is applied with a single voltage.

11. The image forming apparatus according to claim 10, wherein the transfer board comprises a plurality of transfer electrodes arranged along the development agent transfer path, and wherein the transfer board is configured to, when a bias voltage containing a multi-phase alternating-current voltage component is applied to the plurality of transfer electrodes, generate a traveling-wave electric field along the development agent transfer path, and charge and transfer the development agent by the traveling-wave electric field on the development agent transfer path.

12. The image forming apparatus according to claim 10, wherein the facing member is configured to rotate around an axis parallel to the first direction.

13. The image forming apparatus according to claim 10, wherein the facing member is formed in an arc shape along an outer shape of the development agent holding surface when viewed in the first direction.

14. The image forming apparatus according to claim 13, wherein the facing member is formed integrally with the transfer board.

15. The image forming apparatus according to claim 10, wherein the development agent supply device further comprises a cleaner configured to remove, from the facing member, development agent adhering to the facing member.

16. The image forming apparatus according to claim 15, wherein the cleaner comprises a cleaning blade that is disposed to contact the facing member and configured to scrape the development agent adhering to the facing member off from the facing member.

17. The image forming apparatus according to claim 15, wherein the cleaner comprises a cleaning board disposed to face the facing member, wherein the cleaning board comprises a plurality of cleaning electrodes arranged along a cleaning path perpendicular to the first direction, and wherein the cleaning board is configured to, when a bias voltage containing a multi-phase alternating-current voltage component is applied to the plurality of cleaning electrodes, remove from the facing member the development agent adhering to the facing member near a third position where the cleaning board faces the facing member and convey the removed development agent along the cleaning path.

18. The image forming apparatus according to claim 10, wherein the single voltage is a direct-current (DC) voltage, and wherein the development agent holding member is applied with an alternating-current (AC) voltage.

* * * * *